US007185953B1

(12) United States Patent
Young

(10) Patent No.: US 7,185,953 B1
(45) Date of Patent: Mar. 6, 2007

(54) SURFACE SWEEPING MACHINE WITH A DUMP DOOR AND CHUTE ACTUATING MECHANISM

(75) Inventor: Gary B. Young, Waco, TX (US)

(73) Assignee: TYMCO, Inc., Waco, TX (US)

( * ) Notice: Subject to any disclaimer, the term of this patent is extended or adjusted under 35 U.S.C. 154(b) by 0 days.

(21) Appl. No.: 11/210,688

(22) Filed: Aug. 25, 2005

(51) Int. Cl.
*B60P 1/00* (2006.01)

(52) U.S. Cl. ..... 298/24

(58) Field of Classification Search ..... 298/24, 298/17 R, 19 R, 22 R, 22 P, 22 B, 23 R, 298/23 S; 296/57.1, 50, 51, 56
See application file for complete search history.

(56) References Cited

U.S. PATENT DOCUMENTS 534,652 A * 2/1895 Lantz ..... 296/51
1,214,045 A * 1/1917 Lightburne ..... 296/51
3,512,206 A 5/1970 Young
3,545,818 A 12/1970 Young
4,165,897 A * 8/1979 Schmidt ..... 296/56
5,064,248 A * 11/1991 Tegtmeier ..... 298/11
5,072,485 A 12/1991 Young
6,189,976 B1 * 2/2001 Lawson ..... 298/1 B
6,929,329 B2 * 8/2005 Kent et al. ..... 298/7

* cited by examiner

*Primary Examiner*—H Gutman
(74) *Attorney, Agent, or Firm*—Diller, Ramik & Wight

(57) ABSTRACT

A dump hopper for a road sweeper includes a dump door, a debris guide chute, and an actuating mechanism for pivoting the dump door and debris chute between travel and dumping positions. The dump door is sandwiched between a hopper and the guide chute in the travel position and seals a debris discharge opening of the hopper. A pair of fluid cylinders are pivotally connected to the dump door and the guide chute and cooperate with cam and cam followers to hold the dump door in sealed relationship to the debris discharge opening until the debris guide chute has been fully deployed.

62 Claims, 9 Drawing Sheets

FIG. 1
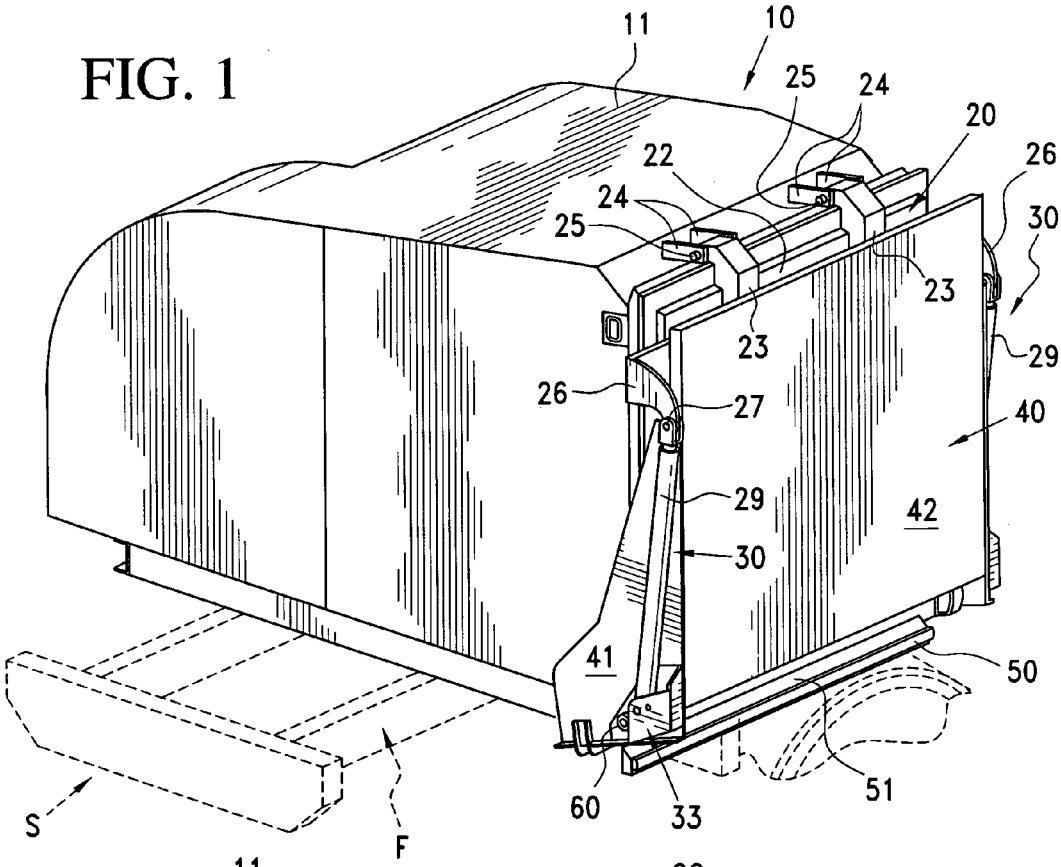
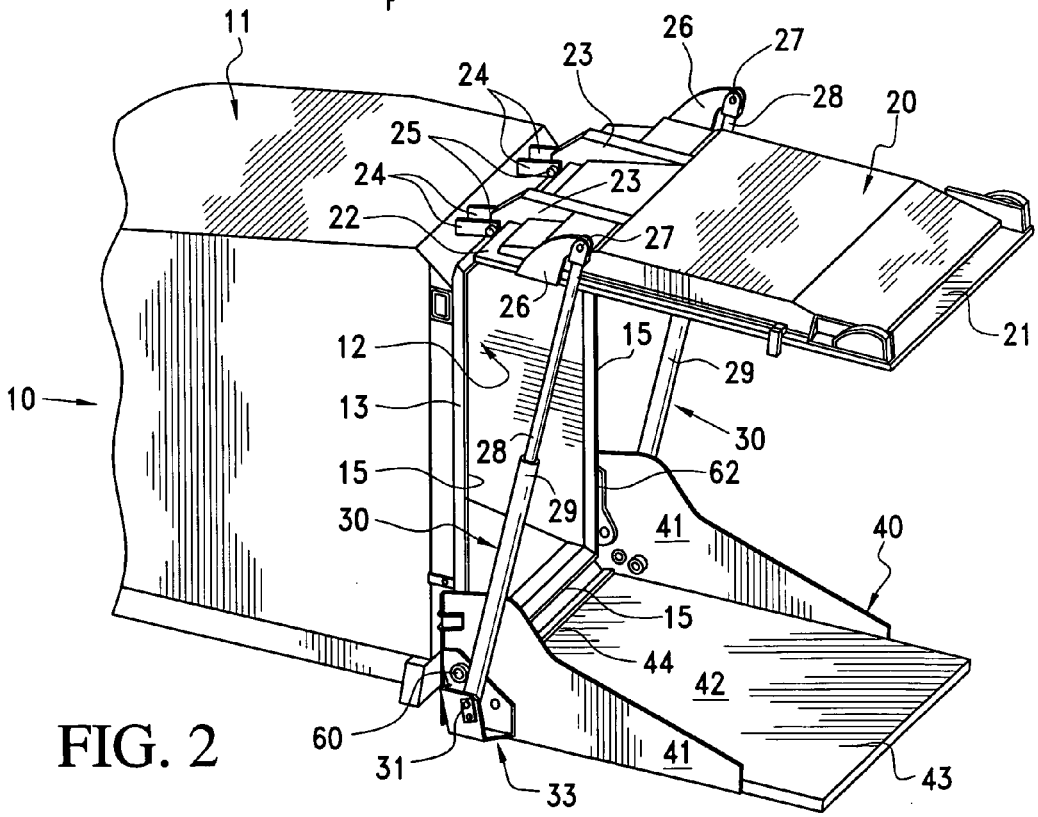
FIG. 2

SURFACE SWEEPING MACHINE WITH A DUMP DOOR AND CHUTE ACTUATING MECHANISM

BACKGROUND OF THE INVENTION

The invention is directed to a surface sweeping machine, commonly referred to as a road sweeper, which utilizes a conventional truck body including a cab and a frame with the latter having mounted thereon a pick-up head, a hopper, a centrifugal separator, a blower, a blower housing, and associated openings and conduits for circulating air-entrained debris through the centrifugal separator and thereby depositing debris in the hopper for subsequent discharge/dumping.

A typical road sweeper of the latter construction is found in U.S. Pat. Nos. 3,512,206 and 3,545,181, each in the name of Bernard W. Young granted on May 19 and Dec. 8, 1970, respectively. A more recent surface sweeping machine having an over-the-cap hopper which pivots to a dumping position is disclosed in U.S. Pat. No. 5,072,485 granted on Dec. 17, 1991 to Gary B. Young et al. In all three of the latter surface sweeping machines or road sweepers debris from the hopper is discharged through a debris opening when the hopper door is pivoted to an open position by a pair of hydraulic cylinders.

SUMMARY OF THE INVENTION

Over the years road sweepers have evolved and the assignee, Tymco, Inc., of the present invention has developed a side-dumping road sweeper in which a blower housing is pivoted away from an associated hopper as the hopper is moved from its travel position toward its dumping position, as is reflected in an application in the name of Gary B. Young et al, entitled Surface Sweeping Machine with Tilting Blower Housing filed on Aug. 8, 2005 and now U.S. application Ser. No. 11/198,358. The latter side-dumping road sweeper utilizes the dump door and chute actuating mechanism of the present invention to achieve dump door opening only after the chute has been pivoted from an inoperative or travel position to an operative debris discharging or debris guiding position. The latter assures that debris will not fall from a discharge opening of the hopper in an indiscriminate manner but instead will be directed away from the hopper opening to a desired point of discharge by the chute.

When both the chute and dump door are in their respective non-dumping and/or travel positions, the dump door is sandwiched between the discharge opening of the hopper and the chute and is held in peripheral sealing engagement relative to the discharge opening. A pair of retracted hydraulic cylinders connected between the chute and the dump door hold the chute and the dump door in the travel position but the hydraulic cylinders are extendable to initially move the chute from a substantially vertical travel position to a guiding position at which debris can be appropriately guided. By virtue of novel cam and cam follower mechanisms associated with the dump door and chute, the chute is substantially completely deployed or pivoted to its guiding position before the dump door is opened and the seal thereof with the hopper opening is "broken" to thereby preclude debris from being discharged inadvertently/accidentally upon an unintended ground area. The latter delayed opening of the dump door associated with an end portion of the chute being disposed substantially vertically beneath the dump door and the hopper opening assure debris will directly enter the chute and will thereafter be appropriately discharged therefrom toward an intended dump area.

Accordingly, in keeping with the present invention, the dump door of the dump hopper is mounted for pivotal movement between a first travel position closing the hopper opening and a second open dumping position at which the hopper opening is open. The chute is similarly pivoted for movement between a first travel position when the dump door is in its first closed position and a second guiding position when the dump door is in its second open position. First and second cooperative means in the form of guide track means and guide track follower means or cam and cam followers are carried one each by the dump door and chute to assure dump door opening only after the chute has been substantially moved toward its second guiding position. Preferably, a single pair of hydraulic cylinders are pivotally connected between the dump door and the chute to effect relative pivoting movement therebetween during movement between the first and second positions thereof.

In further accordance with the present invention, a lower edge of the chute is pivoted beneath a lower edge of the hopper opening and an adjacent edge of the dump door during pivotal movement of the chute from its first travel position toward the chute guiding position and subsequently the dump door pivots to open the hopper opening which when open will discharge debris upon the underlying portion of the chute.

The guide chute essentially holds the dump door closed and sealed until the chute is virtually fully opened thereby assuring debris will not be inadvertently dumped upon an unintended area of the ground.

The hydraulic mechanisms and the associated cams and cam followers associated therewith effect a mechanical lock in the travel position of the hopper under hydraulic pressure through a novel hydraulic system including fluid flow restriction orifices which slow hydraulic cylinder movement during pivotal movement of the chute between closed non-guiding travel and deployed guiding positions thereof to thereby prevent damage and/or personal injury.

In further accordance with the present invention, the hydraulic cylinders pivotally connected to both the dump door and chute define a parallelogram having "legs" so arranged as to allow a person to lift the chute in the range of 30 degrees–40 degrees and at the same time lift the dump door in the range of between 10 degrees–20 degrees. There is substantially a 4 to 1 ratio of cylinder movement with respect to the door and chute movement which is highly desirable due to the relative weights of the chute and door and the fact that the chute and door are pivotally connected to the hopper at respective lower and upper ends thereof.

With the above and other objects in view that will hereinafter appear, the nature of the invention will be more clearly understood by reference to the following detailed description, the appended claims and the several views illustrated in the accompanying drawings.

BRIEF DESCRIPTION OF THE SEVERAL VIEWS OF THE DRAWINGS

FIG. 1 is a fragmentary perspective view of a dump hopper of the present invention, and illustrates a dump door and chute in substantially vertically upright first travel positions thereof and one of a pair of hydraulic cylinders mounted between the dump door and the chute for moving the dump door and chute from the travel positions of FIG. 1 to the dumping and guiding positions of FIG. 2.

FIG. 2 is a fragmentary perspective view of the dump hopper of FIG. 1, and illustrates the dump door in its fully open second dump position and the debris chute in its fully deployed second debris guiding position.

DETAILED DESCRIPTION OF THE PREFERRED EMBODIMENT

Figure 3:
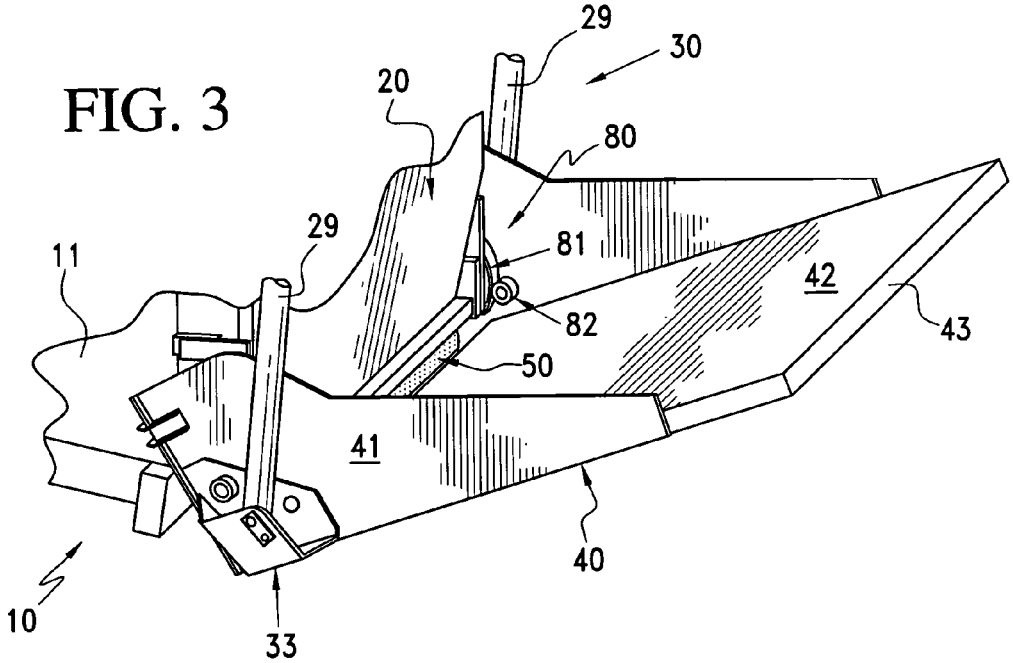
FIG. 3 is a fragmentary perspective view of the dump hopper, and illustrates a cam and cam follower carried respectively by the dump door and the chute for holding the dump door closed until the chute is substantially fully deployed in its debris guiding position of FIG. 2.
Figure 4:
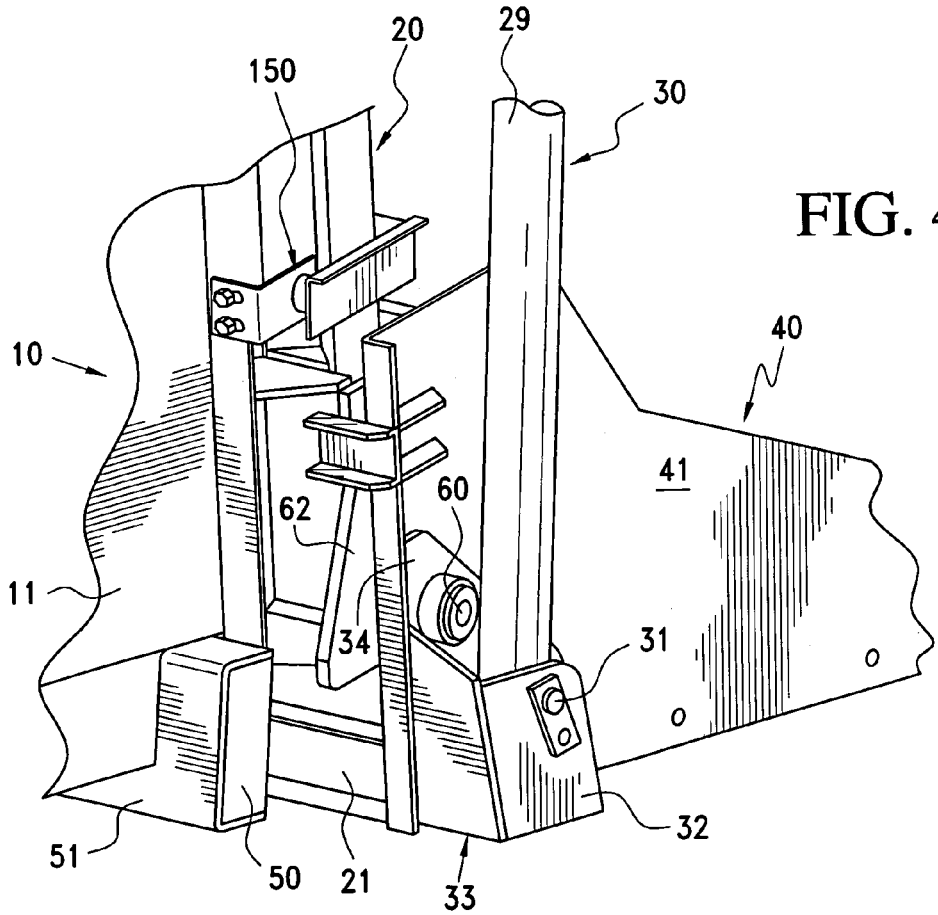
FIG. 4 is a fragmentary enlarged perspective view of a lower corner of the dump hopper, and illustrates a lower edge of the guide chute in sealing engagement with a transverse sealing bar beneath a lower edge of the hopper prior to the dump door moving from its closed position.

A novel dump hopper constructed in accordance with this invention is fully illustrated in FIGS. 1 through 9 of the drawings, and is generally designated by the reference numeral 10.

The dump hopper 10 is supported upon a frame F (FIG. 1) of a surface sweeping machine S, such as a road sweeper which includes a conventional cab (not shown) supported upon the frame F along with conventional unillustrated components, such as a pick-up head, a centrifugal separator, a blower, a blower housing and associated openings and conduits for circulating air-entrained debris through the centrifugal separator and thereby depositing the debris in a container or hopper 11 of the dump hopper 10. The surface sweeping machine S is preferably constructed in accordance with the application pending in the name of Gary B. Young et al. and entitled Surface Sweeping Machine with Tilting Blower Housing referred to earlier herein. In accordance with the latter-identified application, the dump hopper 10 is lifted upwardly from a travel position thereof (FIG. 1) to a dumping position (FIG. 2) by scissor-type linkages and hydraulic cylinders for effecting side-dumping of debris from the hopper 11 in a manner to be described more fully hereinafter.

Figure 5:
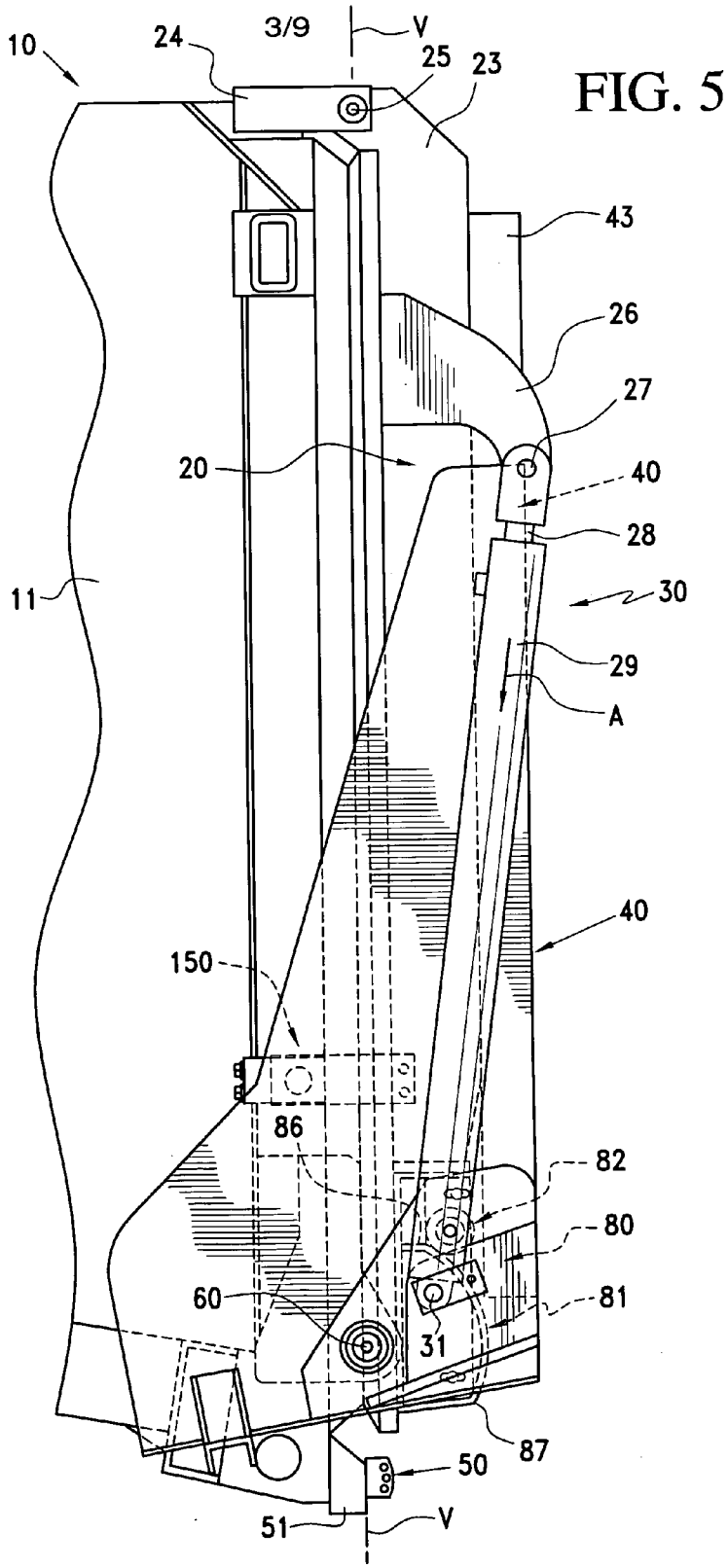
FIG. 5 is a fragmentary side elevational view of the dump hopper, and illustrates the dump door sandwiched between an opening of the hopper and the chute in the first travel positions thereof, respective upper and lower pivots for the dump door and chute, a hydraulic cylinder connected at opposite ends to the dump door and chute, and one of the cam followers of the guide chute seated on an upper portion of the cam track of the dump door.

The hopper or container 11 of the dump hopper 10 includes a debris discharge opening 12 (FIG. 2) of a substantially polygonal or rectangular outline defined by a peripheral wall 13 which carries sealing means or a peripheral seal 15 for sealing the debris discharge opening 12 by an inner surface (unnumbered) of a dump door 20 when the latter is in its non-dumping, closed or travel position best illustrated in FIGS. 1 and 5 of the drawings. Alternatively, the peripheral seal 15 can be carried by the dump door 20 and seal against the peripheral wall 13 of the dump hopper 10. When the dump door 20 is in its travel, non-dumping, closed position, it is disposed substantially vertically and is in sandwiched relationship between the hopper or container 11 and specifically the peripheral wall 13 thereof and a debris guiding chute 40 which is illustrated in its travel position in FIGS. 1 and 5 and in its debris guiding position in FIGS. 2 and 7 of the drawings.

The dump door 20 includes a lowermost end portion 21 and an uppermost end portion 22 to the latter of which is welded a pair of identical transversely spaced bracket or support members 23 each of which is received between a pair of transversely spaced bracket or support members 24 bolted (not shown) to the hopper 11. The members 23, 24 have respective apertures (unnumbered) through which pass pivot pins 25 for pivotally connecting the dump door 20 to the hopper 11 for pivoting movement between the travel/non-dumping position of FIGS. 1 and 5 and the fully open dumping position of FIGS. 2 and 9.

The uppermost end portion 22 of the dump door 20 also includes a pair of downwardly and outwardly tapered or curved brackets 26 (FIGS. 1–7) welded thereto to each of which is pivotally connected by a conventional pivot or pivot pin 27, a piston rod 28 reciprocally fluidically movable relative to a cylinder 29 of a fluid motor or fluid cylinder 30. Each cylinder 29 has a lowermost end (unnumbered) pivotally connected by a pivot pin 31 (FIGS. 5, 6 and 11) to an outer wall 32 of a generally U-shaped bracket 33 (FIG. 11) having an inner wall 34 (FIG. 11) welded to each of opposite generally parallel side walls 41 of the chute 40. As will be described more fully hereinafter, when the fluid cylinders 30 are in the fully retracted positions thereof (FIGS. 1 and 5) the chute 40 and the dump door 20 are held in substantially vertical relationship, but as each rod 28 is telescoped outwardly from its cylinder 29, the debris chute 40 is first substantially fully deployed, during which time the dump door 20 is held sealed relative to the debris discharge opening 12 (FIGS. 1 and 5 through 7) after which continued outward telescopic movement of the rods 28 progressively open the dump door 20 (FIG. 8) to its eventual full-open dumping position (FIGS. 2 and 9), as will be described more fully hereinafter.

Figure 7:
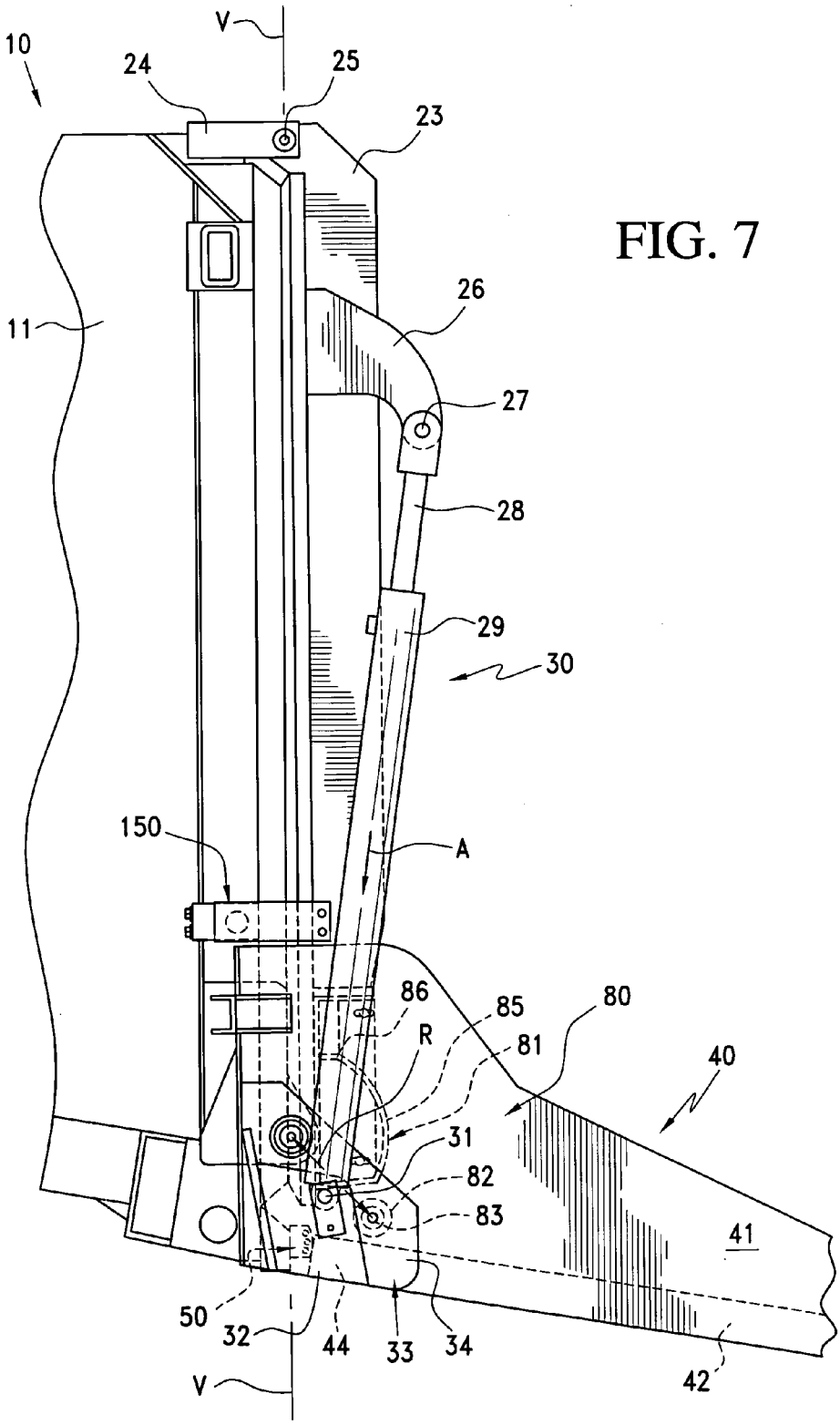
FIG. 7 is a fragmentary side elevational view of the dump hopper, and illustrates the debris chute fully deployed with a lower-most edge in sealing relationship to a transverse sealing bar of the hopper and the cam released from the cam track to initiate pivotal opening movement of the dump door upon continued pressurization of the fluid cylinders.
Figure 8:
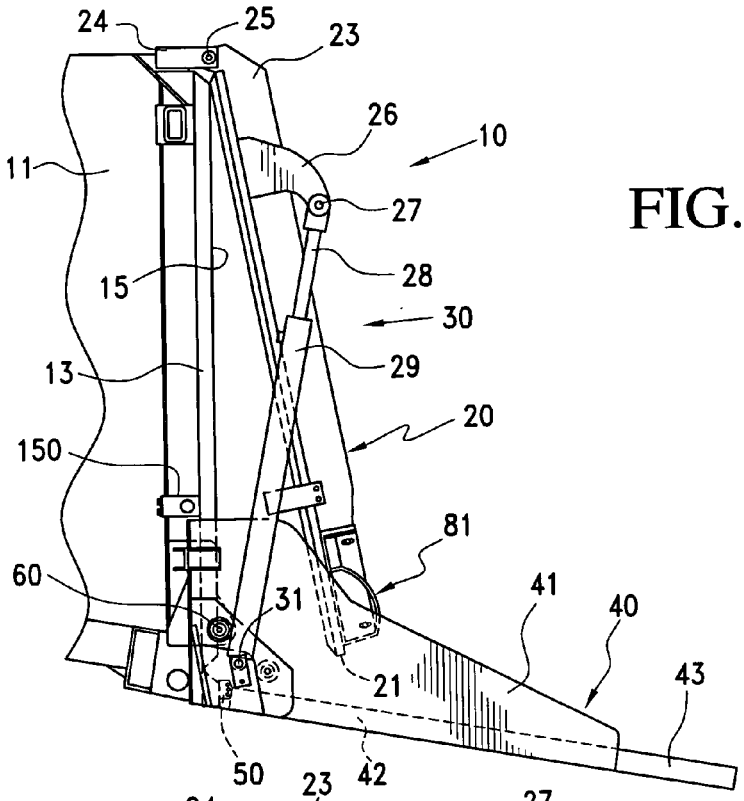
FIG. 8 is a fragmentary side elevational view similar to FIG. 7, and illustrates the initial pivotal movement of the dump door from its closed position of FIG. 7 toward its fully open dumping position of FIGS. 2 and 9.

The debris chute 40 also includes a bottom wall 42 having an outward debris dumping edge or edge portion 43 projecting beyond the side walls 41, 41 and an inwardmost edge portion 44 which in the debris chute guiding position (FIGS. 1,5, 7 and 9) sealing abuts against a resilient transverse sealing bar or sealing means 50 bolted or otherwise secured to a transverse mounting bracket 51 (FIGS. 1, 4 and 5) which is welded to a lower edge (unnumbered) of the hopper 11. As is best illustrated in FIG. 7, the contact between the bottom wall edge portion 44 of the debris chute 40 and the transverse sealing bar 50 prior to the opening of the dump door 20 (FIG. 7) assures that upon the opening of the dump door 20, debris will not inadvertently or accidentally exit the debris discharge opening 12 and fall upon an undesired underlying area of the ground but instead will discharge from the debris discharge opening 12 directly upon the bottom wall 42 and exit the outward edge portion 43 at an intended underlying dump area.

The debris chute 40 is mounted for pivotal movement between the positions latter described by chute mounting means or pivot means in the form of a pivot pin 60 (FIG. 11) which passes through each innermost wall 34 of each U-shaped bracket 33, the adjacent side wall 41, and an opening 61 (FIG. 11) of a flange or plate 62 welded to a lower corner side wall (unnumbered) of the container or hopper 11. The locations of the pins 60 and openings 61 can be reversed. The pin 60 carries conventional fasteners (unnumbered) at axial opposite ends thereof thereby confining each pivot pin 60 within the openings (unnumbered) of the walls 34, 41 and the opening 61 of the flange or plate 62 thus effecting free pivotal movement of the debris chute 40 between the positions illustrated in FIGS. 1 and 2 of the drawings. The pivots 25 of the dump door 20 are, of course, located above and in substantially vertical alignment with the pivots 60 of the debris chute 40, as is most evident from FIG. 7, and lie in a substantially vertical plane V (FIG. 7).

Figure 9:
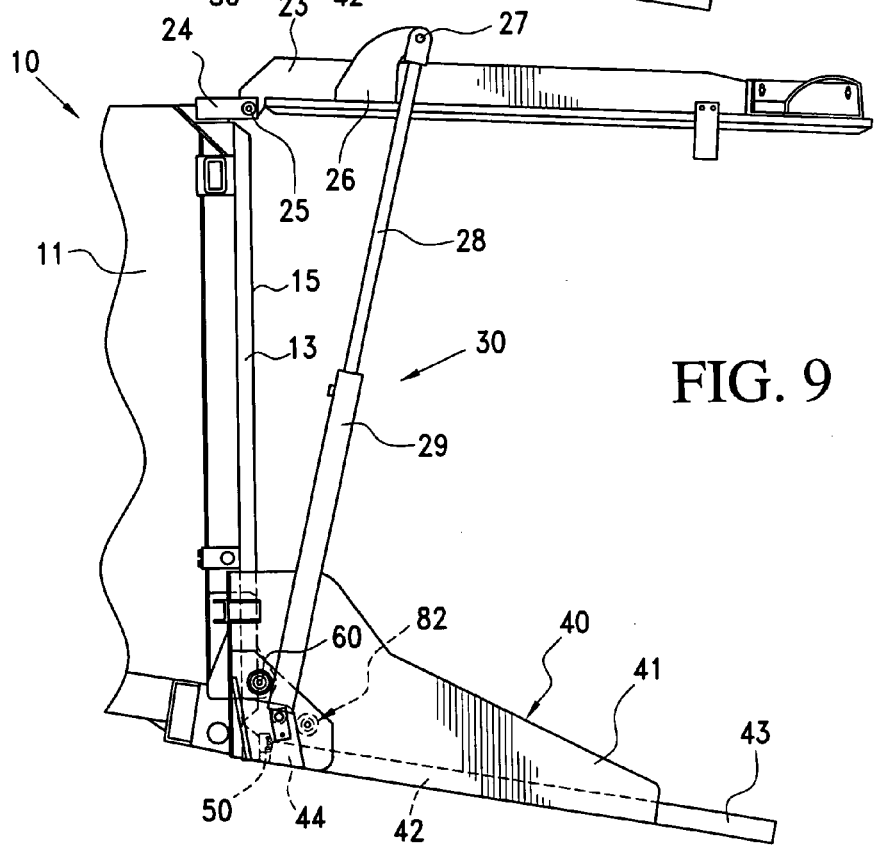
FIG. 9 is a fragmentary side elevational view similar to FIG. 8, and illustrates the dump door and guide chute fully deployed in the second dumping and guiding positions, respectively, thereof.
Figure 10:
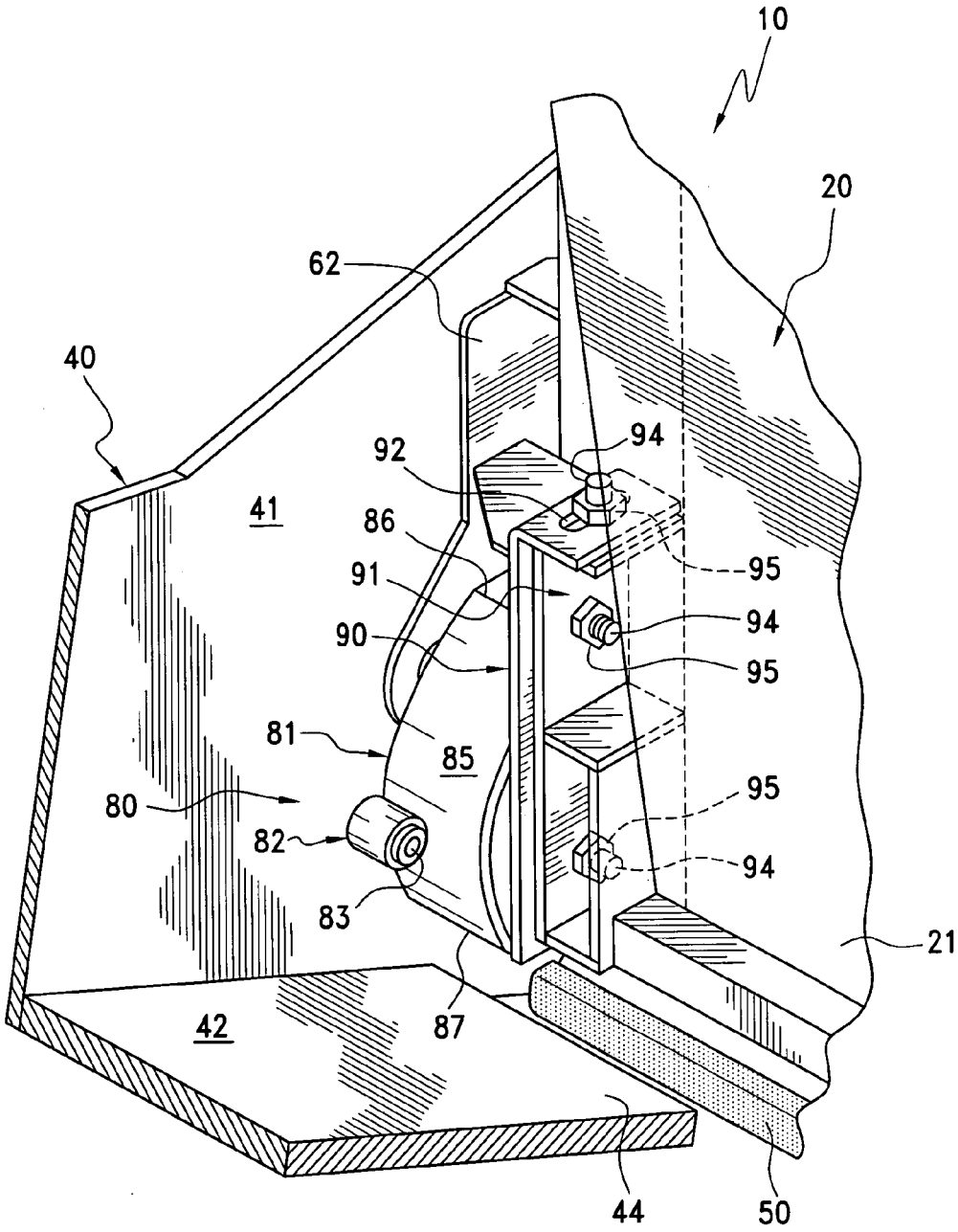
FIG. 10 is an enlarged fragmentary perspective view similar to FIG. 4 but looking rearwardly thereof, and illustrates details of the cam and cam follower carried respectively by the dump door and chute, and slots, bolts and nuts for adjusting the cam or cam track to selectively vary the closing force of the dump door relative to the hopper opening and a peripheral seal associated therewith.
Figure 11:
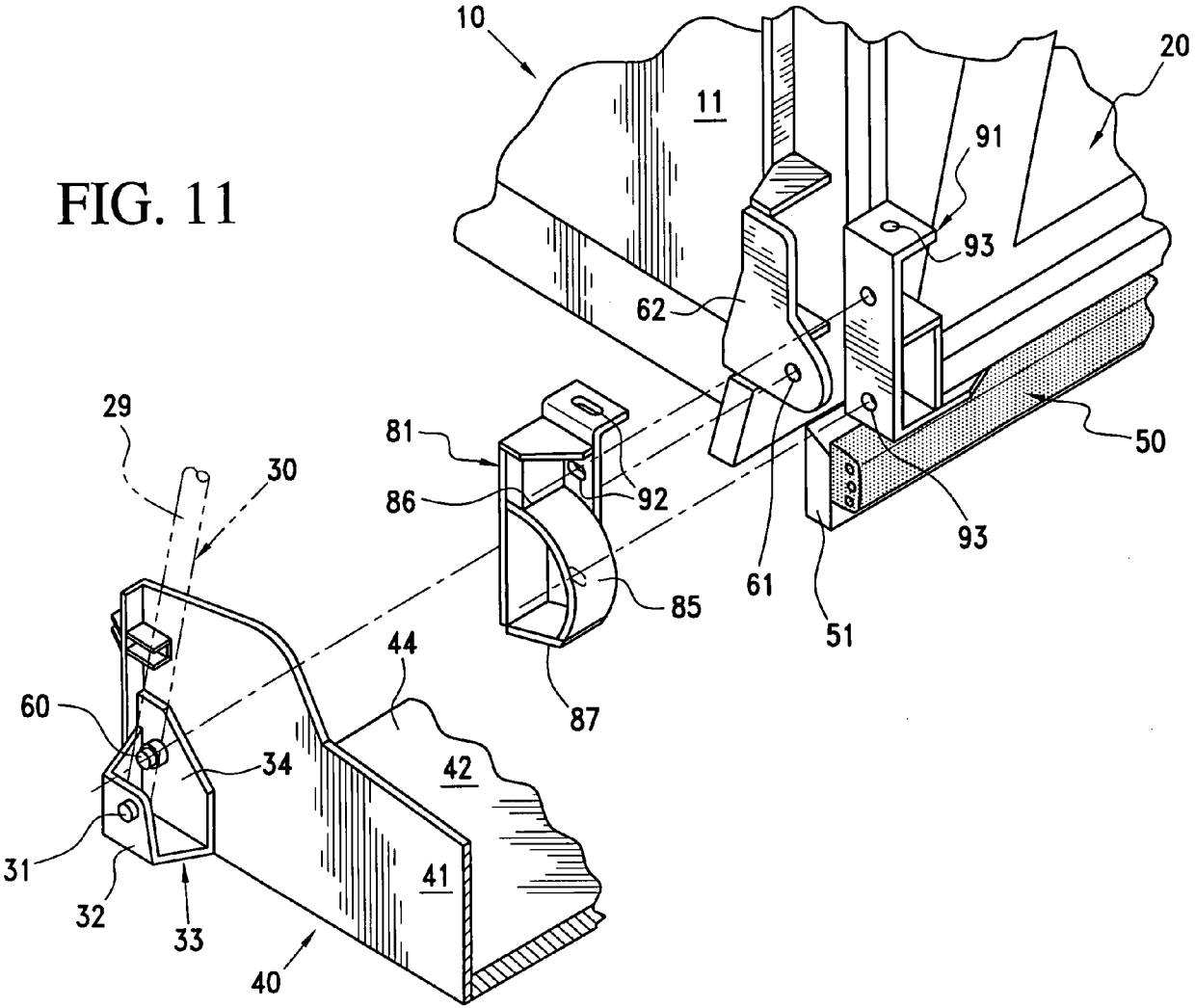
FIG. 11 is a fragmentary exploded view of the elements illustrated in FIG. 10, and illustrates further details thereof including three elongated slots for adjusting the cam track and a flange or weldment to which the guide chute is pivotally connected.

Reference is made specifically to FIGS. 5 through 7, 10 and 11 of the drawings, which illustrate first and second cooperative means 80 for holding the dump door 20 in the first closed, non-dumping or travel position thereof (FIGS. 1 and 5) during movement of the debris guiding chute 40 from the first travel position (FIGS. 1 and 5) toward the second fully deployed debris guiding position (FIGS. 2, 7 and 9) and substantially at the latter position releasing the dump door 20 to free movement thereof from its first closed travel position (FIG. 7) progressively (FIG. 8) toward its fully deployed dumping position (FIGS. 2 and 9). The first and second cooperative means 80 are disposed in cooperative pairs, one at each side corner (unnumbered) of the hopper 11 and each being defined by a cam, cam track or cam guide track 81 and a cam follower, cam track follower or cam guide track follower 82. Each cam follower 82 is a roller free to rotate relative to a pin 83 conventionally fixed to each side wall 41 of the debris chute 40. Axes (unnumbered) of the cam followers or rollers 82 are in coaxial alignment with each other. Each cam or cam track 81 (FIGS. 10 and 11) includes a cam track surface or cam guide track surface 85 which defines a predetermined curved path of travel which corresponds substantially to the arc of travel defined by a radius R (FIGS. 5–7) between each chute pivot 60 and each cam follower pivot 83. Opposite upper and lower ends of the cam track surface 85 of the cam track 81 are indicated by the respective reference characters 86 and 87. The cam track 81 is welded to a generally inverted L-shaped mounting plate 90 (FIGS. 10 and 11) which substantially matches and mates with another inverted L-shaped mounting plate 91 welded at each lower corner (unnumbered) of the dump door 20 adjacent an end (unnumbered) of the transverse bottom sealing bar 50 (FIG. 11). Three in-and-out longitudinal slots 92 of the mounting plate 90 match with three openings 93 (FIG. 11) in the mounting plate 91 through which bolts 94 (FIG. 10) pass and to which are threaded nuts 95. The elongated slots 92 permit selected in-to-out adjustment of each of the cam tracks 81 which can be used to adjust the closing force applied to the dump door 20 in its travel or closed position, as will be more apparent hereinafter, to assure, for example, an adequate seal between the dump door 20 and the peripheral seal 15 no matter the wear on the latter over time.

OPERATION

Figure 12:
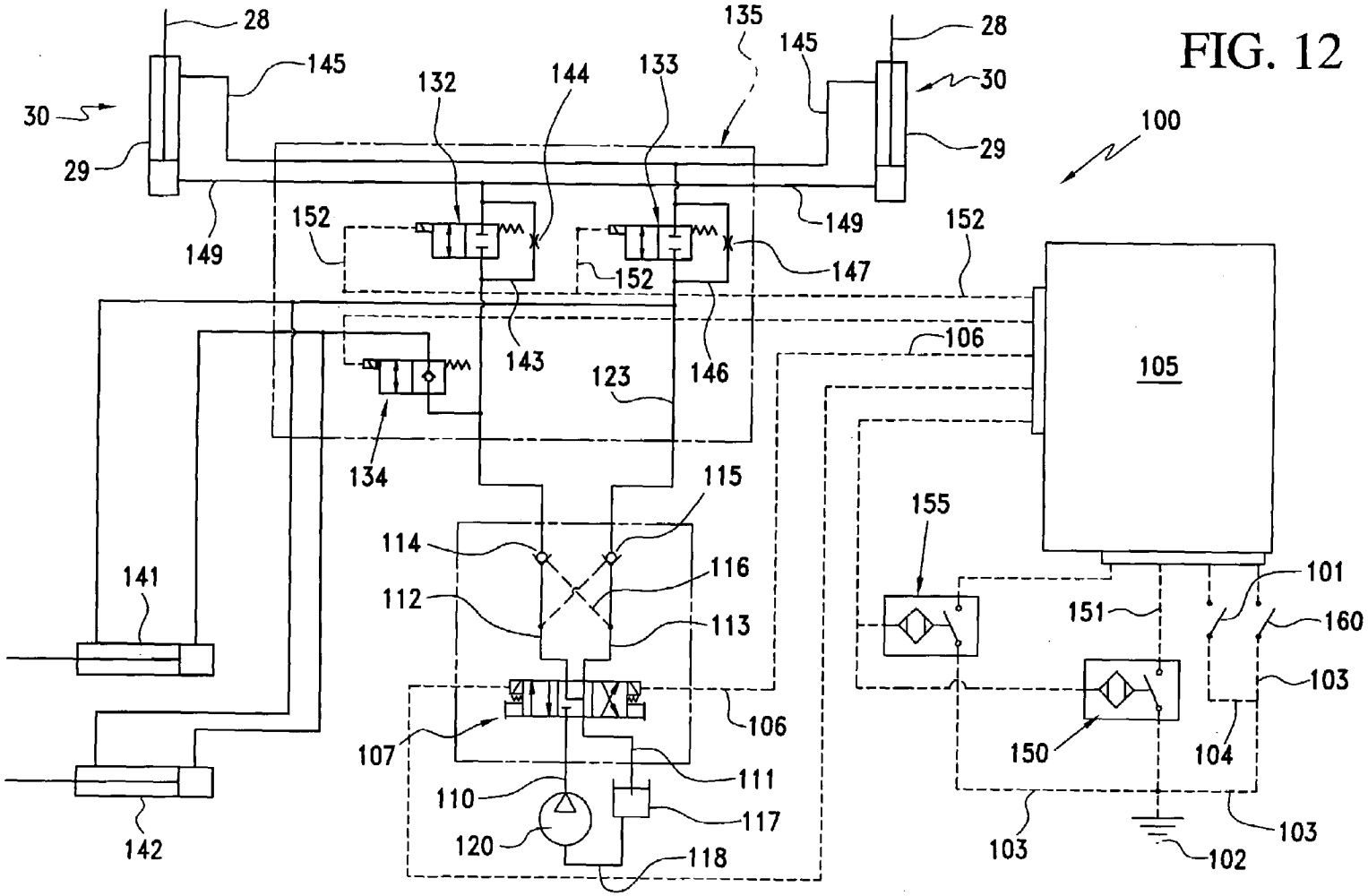
FIG. 12 is an electrical and hydraulic schematic, and illustrates details of a hydraulic system for operating the fluid cylinders to pivot the dump door and debris chute between the first and second positions thereof illustrated respectively in FIGS. 1 and 2.

The operation of the dump hopper and specifically the pivotal movement of the dump door 20 and the chute 40 between the travel positions (FIG. 1) and the dumping/guiding positions (FIG. 2) will be described in conjunction with a dump door and debris chute actuating hydraulic and electronic control system 100 of FIG. 12 of the drawings. It will be assumed that the surface sweeper S has collected considerable debris within the hopper or container 11 of the dump hopper 10 and the dump door 20 and debris chute 40 are in the first or travel positions thereof (FIGS. 1 and 5). In the latter positions of the dump door 20 and the debris chute 40, each cam follower 82 rests upon the upper end portion 86 of its associated cam track surface 85 thereby holding the dump door 20 against the peripheral seal 15 due to the retracted position of the fluid cylinders 30.

When the sweeper S is appropriately parked and stabilized at a dump site, a dump hopper switch 101 (FIG. 12) of the control system 100 is closed which conducts power from a 12-volt source 102, such as a battery, over lines 103, 104 to an input side of a conventional multiplexing PLC (Programmable Logic Controller) 105. The multiplexing PLC controller 105 turns on a 12-volt output and over a line 106 shifts a solenoid operated directional valve 107 to the right bringing its parallel ports (unnumbered) in fluid communication with fluid input conduits 110, 111 and fluid output conduits 112, 113 which include respective extend and retract check valves 114, 115 and conventional cross-over conduits collectively designated by the reference numeral 116. The conduit 111 is connected to a hydraulic (oil) reservoir 117 which is in turn connected by a conduit 118 to a pump 120 driven in a conventional manner to provide full pump flow to the conduit 110. The extend check valve 114 is free-flowing to deliver hydraulic pressure to a hydraulic extend conduit 122 while the retract check valve 115 returns hydraulic fluid to the reservoir 117 from a hydraulic return conduit 123. There are three solenoid operated directional valves 132–134 forming part of a dump door/chute manifold hydraulic circuit 135, and each solenoid operated valve 132–134 is illustrated in FIG. 12 in its normal position. Therefore, flow to a pair of hopper tilt cylinders 141, 142 is blocked by the closed hopper tilt cylinder valve 134. The hopper tilt cylinders 141, 142 form no part of the present invention but are fully disclosed in the latter-identified application in the name of Gary B. Young et al., entitled "Surface Sweeping Machine with Tilting Blower Housing." Fluid under pressure in the hydraulic extend conduit 122 by-passes the closed solenoid valve 132 through a parallel conduit 143 having a flow restriction orifice 144 which is then delivered to the cylinder end (unnumbered) of each cylinder 29 through conduits 149 which extend each rod 28 of each fluid cylinder 30 with return fluid being delivered from the rod end of each cylinder 29 through a conduit 145, a by-pass conduit 146 of the solenoid valve 133 and a flow restriction orifice 147 therein to the line 123. The flow restriction orifices 144, 147 slow the extension speed of the rod 28 and cylinder 29 of each fluid cylinder 30 during initial operation of the fluid cylinders 30 from the retracted position thereof (FIGS. 1 and 5).

Figure 6:
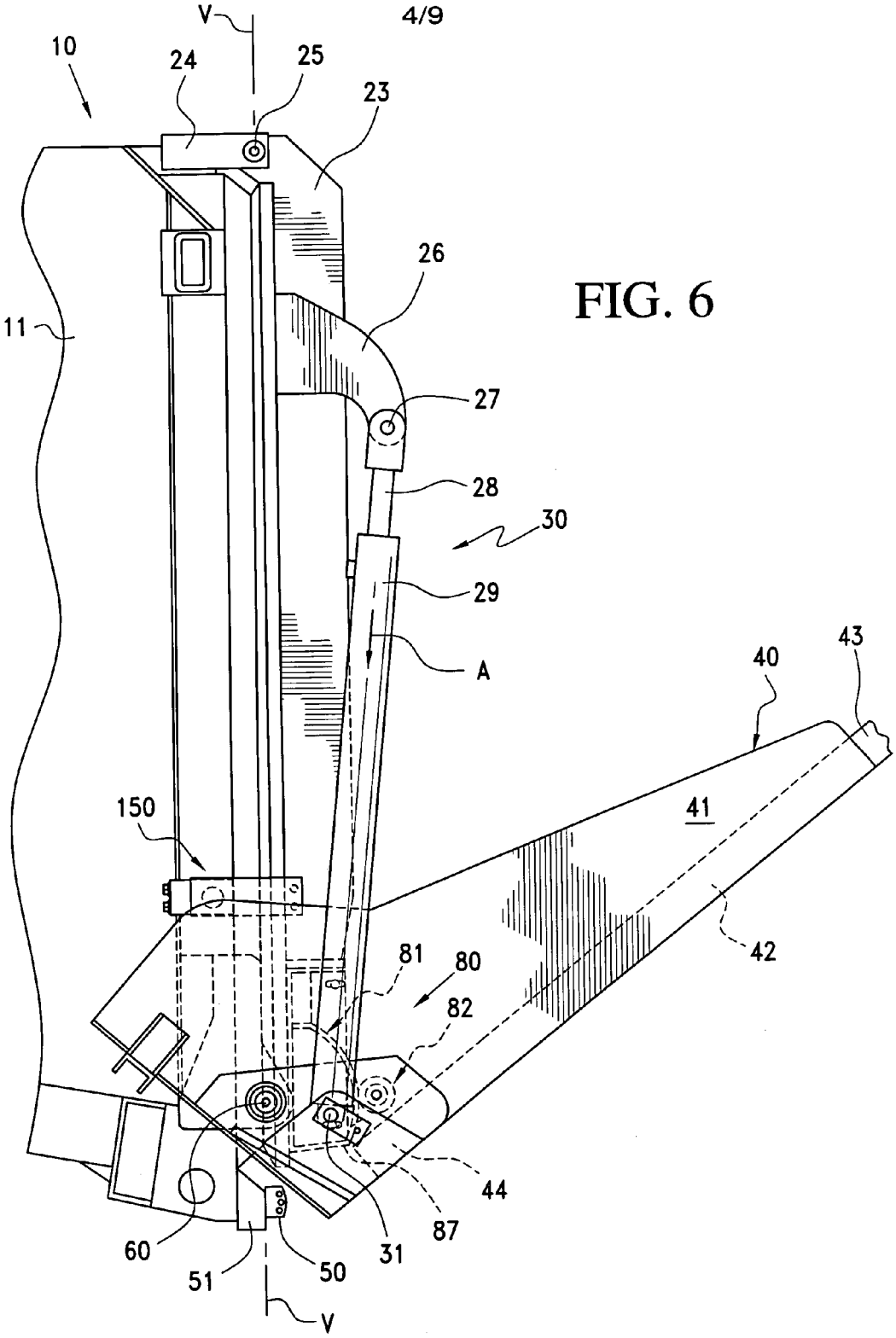
FIG. 6 is a fragmentary side elevational view similar to FIG. 5, and illustrates the debris chute being pivoted from its travel position toward its fully deployed position during which the cam follower moves along the cam track and holds the dump door in its travel or closed position.

The cylinders 29 initially move downwardly, as indicated by the headed arrow A in FIG. 5, and through each pivot pin 31 progressively pivot the debris chute 40 thereabout in the manner indicated by the headed arrow A associated therewith in FIGS. 5, 6 and 7. During the same movement each cam follower 82 rides along the cam track surface 85 from the position shown in FIG. 5 adjacent the cam track surface upper end 86 progressively (FIGS. 3 and 6) and ultimately to the final position shown in FIG. 7 at which the guide chute 40 is fully deployed. Since each cam track 81 is carried by the dump door 20 at corners (unnumbered) thereof, the cam follower 82 associated therewith maintains a closing force against the dump door 20 (FIGS. 5, 6 and 10) which prevents dump door opening movement until the cam follower 82 moves beyond the cam track surface lower end 87. Once the dump door 20 is released (FIG. 7) and the debris chute 40 is fully deployed (FIG. 7) continued relative extension between the rods 28 and cylinders 29 begins upward pivotal movement of the dump door 20 through the pivot pins 27 (FIGS. 7 and 8), and the brackets 26. As the dump door 20 begins pivoting about the pivot pins 25 (FIG. 8) to open, chute proximity switch 150 (FIGS. 4, 7 and 12) is closed which delivers input over a line 151 to the PLC controller 105 which in turn delivers a 12-volt output over a line 152 to each of the solenoid valves 132, 133 shifting the same to the right which breaks fluid flow through the restriction orifices 144, 147 and directs full flow line pressure from the hydraulic extension conduit 122, the now-shifted solenoid valve 132 and the conduits 149 to allow full pump flow to enter the rod ends of the cylinders 29 thereby speeding up the extension thereof and allowing the dump door 40 to pivot more rapidly to its full open dump position (FIGS. 2 and 9).

The debris guide chute travel between closed (FIG. 2) and fully open or deployed (FIG. 1) positions utilizes approximately 7 inches of the rod/cylinder 27 inch travel while the movement of the dump door 20 utilizes the remaining 20 inches. Absent the previously described flow control provided by the flow restriction orifices 144, 147, the pivoting of the debris guide chute 40 would be approximately three times the pivoting speed of the dump door 20. The latter is a result of both the fluid restriction orifices 144, 146 and the geometry and location of the fluid cylinders 30 and the pivots 25, 27, 31 thereof connecting the respective rods 28 and cylinders 29 to the dump door 20 and the debris guide chute 40.

The hopper tilt cylinders 141, 142 (FIG. 12) are locked by the tilt lock solenoid valve 134 to prevent extension of the hopper tilt cylinders 141, 142 until both the chute orifice proximity switch 150 and a minimum dump height proximity switch 155 (FIG. 12) are both switched on. The minimum dump height proximity switch 155 is located on the frame F (not shown) and closes when the dump hopper 10 has been raised or lifted approximately 15 inches from the position illustrated in FIG. 1 resting upon the frame F in the manner more fully described in the latter identified application in the name of Gary B. Young et al.

It is to be particularly noted that in the fully deployed debris guiding position of the debris guide chute 40 (FIGS. 2, 7 and 9), the inward edge portion 44 (FIG. 7) of the guide chute 40 is in sealing engagement with the transverse sealing bar 50 and is also beneath the lowermost edge (unnumbered) of the debris discharge opening 12 of the hopper 11. In the latter position the dump door 20 has not begun opening but upon initiation of the opening thereof in the manner heretofore described, debris exiting the debris discharge opening 12 will fall upon the forward end portion 44 of the debris guide chute 40 and will be constrained by the side walls 41 for subsequent discharge beyond the outwardmost end portion 43 to a desired dump area upon the ground (not shown). Thus, by locating the inward end portion 44 of the bottom wall 42 of the debris guide chute 40 beneath the discharge opening 12 prior to the opening of the dump door 20, none of the debris exiting the discharge opening 12 will inadvertently or accidentally be discharged upon the ground other than in the desired area.

Upon complete extension of the rods 28 relative to the cylinders 29 of the fluid cylinders 30, the dump door 20 eventually reaches its full open position (FIGS. 2 and 9) and upon completion of debris dumping, a hopper dump closed switch 160 (FIG. 12) is closed by the operator which through the PLC controller 105 and the line 106 shifts the control valve 107 to the left placing the crossing ports (unnumbered) thereof in fluid communication with the conduits 111, 112; 110, 113. The latter connects pump pressure from the pump 120 to the conduit 113 and return flow through the line 111 to the reservoir 117. The retract check valve 115 is free-flowing and the extend check valve 114 is piloted to its open position by the pressure in the conduit 113. Since the dump door 20 is open, the solenoid valves 132, 133 are shifted to their free flow positions and hydraulic fluid flows at full flow through conduits 145 to the rod side of the dump door cylinders 30 (as well as to the rod side of the hopper tilt cylinders 141, 142). The sequence of the tilt of the dump hopper 10 and the closing of the door 20 is determined by gravity and the required pressure to move the respective fluid cylinders 30, 141, 142. Generally, the dump hopper 10 will tilt down and the dump door 20 will begin closing at the same time during which the debris guide chute 40 remains in its fully deployed position. However, once the dump hopper 10 is returned to its "home" position upon the frame F and the dump door 20 is closed, the chute proximity switch 150 opens and turns off the solenoid valves 132, 133 and 134 of the manifold 135. The latter restricts flow to the rod side of the cylinders 29 and thereby slows the upward closing movement of the debris guide chute 40 from the position shown in FIGS. 2 and 7 to the travel position shown in FIGS. 1 and 5. During the latter pivoting movement of the debris guide chute 40, the cam followers 82 ride along each of the cam track surfaces 85 from the lower cam track surface edges 81 to the upper cam track surface edges 86 thereby progressively closing and holding the dump door 20 closed against the seal 15. The now empty dump hopper 10 and its components are once again in the travel position of the road sweeper S for subsequent repetitive operation.

Although a preferred embodiment of the invention has been specifically illustrated and described herein, it is to be understood that minor variations may be made in the apparatus without departing from the spirit and scope of the invention, as defined by the appended claims.

What is claimed is:

1. A dump hopper comprising a container, an opening in the container, a dump door, means for mounting the dump door for movement between a first closed position closing the container opening and a second open position at which the container opening is open, a chute for guiding the discharge of contents outwardly of the container opening when the dump door is in the second open position thereof, means for mounting the chute for movement between a first travel position when the dump door is in the first closed position thereof and a second guiding position when the dump door is in the second open position thereof, and first and second cooperative means for holding the dump door in the first closed position thereof during movement of the chute from the first travel position toward the second guiding position and releasing the dump door to free movement thereof from the first closed position incident to the chute reaching substantially the second guiding position thereof.

2. The dump hopper as defined in claim 1 wherein said first and second cooperative means are carried respectively by the chute and dump door.

3. The dump hopper as defined in claim 1 wherein said first and second cooperative means are cooperative guide track means and guide track follower means carried one by said dump door and one by said chute.

4. The dump hopper as defined in claim 3 wherein said dump door and chute are disposed in substantially upright relationship to each other in the respective first closed and first travel positions thereof, means between said dump door and said container for sealing said container opening in the respective first closed and first travel positions thereof, and said first and second cooperative means maintain said sealing means in sealing relationship during movement of the chute from the first travel position toward the second guiding position.

5. The dump hopper as defined in claim 3 wherein said dump door and chute are disposed in substantially upright relationship to each other in the respective first closed and first travel positions thereof, means between said dump door and said container for sealing said container opening in the respective first closed and first travel positions thereof, and said first and second cooperative means maintain said sealing means in sealing relationship during movement of the chute from the first travel position toward the second guiding position and release said sealing means sealing relationship substantially as said chute reaches the second guiding position thereof.

6. The dump hopper as defined in claim 3 wherein said dump door and chute are disposed in substantially upright relationship to each other in the respective first closed and first travel positions thereof, said dump door being located between said container opening and said chute in the respective first closed and first travel positions thereof, means between said dump door and said container for sealing said container opening in the respective first closed and first travel positions thereof, and said first and second cooperative means maintain said sealing means in sealing relationship during movement of the chute from the first travel position toward the second guiding position.

7. The dump hopper as defined in claim 1 wherein said first and second cooperative means are cooperative guide track means and guide track follower means carried by one by said dump door and one by said chute, said chute mounting means includes pivot means for effecting pivoting movement of said chute between the first travel and second guiding positions thereof, said guide track follower means is carried at a predetermined distance from said pivot means to thereby define a predetermined arc of travel of said guide track follower means during pivoting movement of said chute between the first travel and second guiding positions thereof, said guide track means defines a predetermined path of travel along which said guide track follower means travels during chute pivoting movement, and the predetermined arc of travel and path of travel are substantially the same.

8. The dump hopper as defined in claim 1 wherein said first and second cooperative means are cooperative guide track means and guide track follower means carried one by said door and one by said chute, the dump door mounting means includes pivot means for effecting pivoting movement of said dump door between the first closed and second open positions thereof, the chute mounting means includes pivot means for effecting pivoting movement of said chute between the first travel and second guiding positions thereof, and said pivot means are located in substantially vertically spaced relationship to each other.

9. The dump hopper as defined in claim 1 wherein said first and second cooperative means are cooperative guide track means and guide track follower means carried one by said door and one by said chute, the dump door mounting means includes pivot means for effecting pivoting movement of said dump door between the first closed and second open positions thereof, the chute mounting means includes pivot means for effecting pivoting movement of said chute between the first travel and second guiding positions thereof, and said pivot means are located in substantially vertically spaced relationship to each other with said dump door pivot means being above said chute pivot means.

10. The dump hopper as defined in claim 1 wherein said first and second cooperative means are cooperative guide track means and guide track follower means carried one by said door and one by said chute, the dump door mounting means includes pivot means for effecting pivoting movement of said dump door between the first closed and second open positions thereof, the chute mounting means includes pivot means for effecting pivoting movement of said chute between the first travel and second guiding positions thereof, and said pivot means are located in substantially vertically spaced relationship to each other with axes thereof being in substantially parallel relationship to each other.

11. The dump hopper as defined in claim 1 wherein said first and second cooperative means are cooperative guide track means and guide track follower means carried one by said door and one by said chute, the dump door mounting means includes pivot means for effecting pivoting movement of said dump door between the first closed and second open positions thereof, the chute mounting means includes pivot means for effecting pivoting movement of said chute between the first travel and second guiding positions thereof, and said pivot means are located in substantially vertically spaced relationship to each other with said dump door pivot means being above said chute pivot means and axes thereof being in substantially parallel relationship to each other.

12. The dump hopper as defined in claim 1 wherein said dump door and chute are disposed in substantially upright relationship to each other in the respective first closed and first travel positions thereof, means between said dump door and said container for sealing said container opening in the respective first closed and first travel positions thereof, and said first and second cooperative means maintain said sealing means in sealing relationship during movement of the chute from the first travel position toward the second guiding position.

13. The dump hopper as defined in claim 1 wherein said dump door and chute are disposed in substantially upright relationship to each other in the respective first closed and first travel positions thereof, means between said dump door and said container for sealing said container opening in the respective first closed and first travel positions thereof, and said first and second cooperative means maintain said sealing means in sealing relationship during movement of the chute from the first travel position toward the second guiding position and release said sealing means sealing relationship substantially as said chute reaches the second guiding position thereof.

14. The dump hopper as defined in claim 1 wherein said dump door and chute are disposed in substantially upright relationship to each other in the respective first closed and first travel positions thereof, said dump door being located between said container opening and said chute in the respective first closed and first travel positions thereof, means between said dump door and said container for sealing said container opening in the respective first closed and first travel positions thereof, and said first and second cooperative means maintain said sealing means in sealing relationship during movement of the chute from the first travel position toward the second guiding position.

15. The dump hopper as defined in claim 1 wherein said dump door and chute are disposed in substantially upright relationship to each other in the respective first closed and first travel positions thereof, means between said dump door and said container for sealing said container opening in the respective first closed and first travel positions thereof, said first and second cooperative means maintain said sealing means in sealing relationship during movement of the chute from the first travel position toward the second guiding position, said dump door being located between said container opening and said chute in the respective first closed and first travel positions thereof, said chute having an inward edge portion and an outward edge portion respectively adjacent and remote from said chute pivot means, and said chute inward edge portion being located beneath a lowermost edge of said container opening during dump door pivoting movement from said closed position toward said second open position.

16. The dump hopper as defined in claim 1 wherein said dump door and chute are disposed in substantially upright relationship to each other in the respective first closed and first travel positions thereof, means between said dump door and said container for sealing said container opening in the respective first closed and first travel positions thereof, said first and second cooperative means maintain said sealing means in sealing relationship during movement of the chute from the first travel position toward the second guiding position, said dump door being located between said container opening and said chute in the respective first closed and first travel positions thereof, said chute having an inward edge portion and an outward edge portion respectively adjacent and remote from said chute pivot means, said chute inward edge portion being located beneath a lowermost edge of said container opening during dump door pivoting movement from said closed position toward said second open position, the dump door mounting means includes pivot means for effecting pivoting movement of said dump door between the first closed and second open positions thereof, the chute mounting means includes pivot means for effecting pivoting movement of said chute between the first travel and second guiding positions thereof, and said pivot means are located in substantially vertically spaced relationship to each other.

17. The dump hopper as defined in claim 1 wherein said dump door and chute are disposed in substantially upright relationship to each other in the respective first closed and first travel positions thereof, means between said dump door and said container for sealing said container opening in the respective first closed and first travel positions thereof, said first and second cooperative means maintain said sealing means in sealing relationship during movement of the chute from the first travel position toward the second guiding position, said dump door being located between said container opening and said chute in the respective first closed and first travel positions thereof, said chute having an inward edge portion and an outward edge portion respectively adjacent and remote from said chute pivot means, said chute inward edge portion being located beneath a lowermost edge of said container opening during dump door pivoting movement from said closed position toward said second open position, the dump door mounting means includes pivot means for effecting pivoting movement of said dump door between the first closed and second open positions thereof, the chute mounting means includes pivot means for effecting pivoting movement of said chute between the first travel and second guiding positions thereof, and said pivot means are located in substantially vertically spaced relationship to each other with said dump door pivot means being above said chute pivot means.

18. The dump hopper as defined in claim 1 wherein said dump door and chute are disposed in substantially upright relationship to each other in the respective first closed and first travel positions thereof, means between said dump door and said container for sealing said container opening in the respective first closed and first travel positions thereof, said first and second cooperative means maintain said sealing means in sealing relationship during movement of the chute from the first travel position toward the second guiding position, said dump door being located between said container opening and said chute in the respective first closed and first travel positions thereof, said chute having an inward edge portion and an outward edge portion respectively adjacent and remote from said chute pivot means, and said chute inward edge portion being located beneath a lowermost edge of said container opening during dump door pivoting movement from said closed position toward said second open position, the dump door mounting means includes pivot means for effecting pivoting movement of said dump door between the first closed and second open positions thereof, the chute mounting means includes pivot means for effecting pivoting movement of said chute between the first travel and second guiding positions thereof, and said pivot means are located in substantially vertically spaced relationship to each other with axes thereof being in substantially parallel relationship to each other.

19. The dump hopper as defined in claim 1 wherein said dump door and chute are disposed in substantially upright relationship to each other in the respective first closed and first travel positions thereof, means between said dump door and said container for sealing said container opening in the respective first closed and first travel positions thereof, said first and second cooperative means maintain said sealing means in sealing relationship during movement of the chute from the first travel position toward the second guiding position, said dump door being located between said container opening and said chute in the respective first closed and first travel positions thereof, said chute having an inward edge portion and an outward edge portion respectively adjacent and remote from said chute pivot means, and said chute inward edge portion being located beneath a lowermost edge of said container opening during dump door pivoting movement from said closed position toward said second open position, the dump door mounting means includes pivot means for effecting pivoting movement of said dump door between the first closed and second open positions thereof, the chute mounting means includes pivot means for effecting pivoting movement of said chute between the first travel and second guiding positions thereof, and said pivot means are located in substantially vertically spaced relationship to each other with said dump door pivot means being above said chute pivot means with axes thereof being in substantially parallel relationship to each other.

20. The dump hopper as defined in claim 1 including means for moving said dump door and said chute between the respective first and second positions thereof.

21. The dump hopper as defined in claim 1 including means for moving said dump door and said chute between the respective first and second positions thereof, and said dump door and chute moving means are connected to said dump door and to said chute.

22. The dump hopper as defined in claim 1 including means for moving said dump door and said chute between the respective first and second positions thereof, and said dump door and chute moving means are pivotally connected to said dump door and to said chute.

23. The dump hopper as defined in claim 1 including means for moving said dump door and said chute between the respective first and second positions thereof, and said dump door and chute moving means are connected between said dump door and said chute.

24. The dump hopper as defined in claim 1 including means for moving said dump door and said chute between the respective first and second positions thereof, and said dump door and chute moving means are pivotally connected to and between said dump door and said chute.

25. The dump hopper as defined in claim 1 wherein said chute mounting means includes pivot means for effecting pivoting movement of said chute between the first travel and second guiding positions thereof, said first and second cooperative means are cooperative guide track means and guide track follower means carried one each by one of said dump door and chute, said guide track follower means is carried at a predetermined distance from said pivot means to thereby define a predetermined arc of travel of said guide track follower means during pivoting movement of said chute between the first travel and second guiding positions thereof, said guide track means defines a predetermined path of travel along which said guide track follower means travels during chute pivoting movement, and the predetermined arc of travel and path of travel are substantially the same.

26. The dump hopper as defined in claim 1 wherein the dump door mounting means includes pivot means for effecting pivoting movement of said dump door between the first closed and second open positions thereof, the chute mounting means includes pivot means for effecting pivoting movement of said chute between the first travel and second guiding positions thereof, and said pivot means are located in substantially vertically spaced relationship to each other.

27. The dump hopper as defined in claim 1 wherein the dump door mounting means includes pivot means for effecting pivoting movement of said dump door between the first closed and second open positions thereof, the chute mounting means includes pivot means for effecting pivoting movement of said chute between the first travel and second guiding positions thereof, and said pivot means are located in substantially vertically spaced relationship to each other with said dump door pivot means being above said chute pivot means.

28. The dump hopper as defined in claim 1 wherein the dump door mounting means includes pivot means for effecting pivoting movement of said dump door between the first closed and second open positions thereof, the chute mounting means includes pivot means for effecting pivoting movement of said chute between the first travel and second guiding positions thereof, and said pivot means are located in substantially vertically spaced relationship to each other with axes thereof being in substantially parallel relationship to each other.

29. The dump hopper as defined in claim 1 wherein the dump door mounting means includes pivot means for effecting pivoting movement of said dump door between the first closed and second open positions thereof, the chute mounting means includes pivot means for effecting pivoting movement of said chute between the first travel and second guiding positions thereof, and said pivot means are located in substantially vertically spaced relationship to each other with said dump door pivot means being above said chute pivot means and axes thereof being in substantially parallel relationship to each other.

30. A dump hopper comprising a container, an opening in the container, a dump door, means for mounting the dump door for movement between a first closed position closing the container opening and a second open position at which the container opening is open, a chute for guiding the discharge of contents outwardly of the container opening when the dump door is in the second open position thereof, means for mounting the chute for movement between a first travel position when the dump door is in the first closed position thereof and a second guiding position when the dump door is in the second open position thereof, means for moving said dump door and said chute between the respective first and second positions thereof, and said moving means are connected to said dump door and to said chute.

31. The dump hopper as defined in claim 30 wherein said moving means are connected between said dump door and said chute.

32. The dump hopper as defined in claim 31 wherein said moving means includes relatively reciprocally movable members.

33. The dump hopper as defined in claim 31 wherein said moving means include relatively reciprocally fluidically movable members.

34. The dump hopper as defined in claim 31 wherein said moving means include relatively reciprocally fluidically movable telescopic members.

35. The dump hopper as defined in claim 31 wherein said moving means include relatively reciprocally fluidically movable members, a fluid system in part defined by said fluidically movable members, said fluid system including means for fluidically controlling the speed of chute movement during the movement thereof from the first travel position to the second guiding position, means for sensing initial dump door movement upon arrival of the chute at the second guiding position, means responsive to said sensing means for increasing fluid flow to said fluidically movable members to increase speed upon initial movement of said dump door from the first closed position to the second open position thereof, and said fluidically controlling means includes means in said fluid system for restricting fluid flow into a chamber defined by said fluidically movable members to thereby automatically maintain relatively slow movement of said chute toward the second guiding position thereof.

36. The dump hopper as defined in claim 31 wherein said moving means include relatively reciprocally fluidically movable telescopic members, a fluid system in part defined by said fluidically movable members, said fluid system including means for fluidically controlling the speed of chute movement during the movement thereof from the first travel position to the second guiding position, means for sensing initial dump door movement upon arrival of the chute at the second guiding position, and means responsive to said sensing means for increasing fluid flow to said fluidically movable members to increase speed upon initial movement of said dump door from the first closed position to the second open position thereof.

37. The dump hopper as defined in claim 31 wherein said moving means include relatively reciprocally fluidically movable telescopic members, a fluid system in part defined by said fluidically movable members, said fluid system including means for fluidically controlling the speed of chute movement during the movement thereof from the first travel position to the second guiding position, means for sensing initial dump door movement upon arrival of the chute at the second guiding position, means responsive to said sensing means for increasing fluid flow to said fluidically movable members to increase speed upon initial movement of said dump door from the first closed position to the second open position thereof, and said sensing means is a proximity switch which senses the initial movement of the door.

38. The dump hopper as defined in claim 31 wherein said moving means include relatively reciprocally fluidically movable telescopic members, a fluid system in part defined by said fluidically movable members, said fluid system including means for fluidically controlling the speed of chute movement during the movement thereof from the first travel position to the second guiding position, means for sensing initial dump door movement upon arrival of the chute at the second guiding position, means responsive to said sensing means for increasing fluid flow to said fluidically movable members to increase speed upon initial movement of said dump door from the first closed position to the second open position thereof, and said fluidically controlling means includes means in said fluid system for restricting fluid flow into a chamber defined by said fluidically movable members to thereby automatically maintain relatively slow movement of said chute toward the second guiding position thereof.

39. The dump hopper as defined in claim 30 wherein said moving means are connected between said dump door and said chute, and said moving means are pivotally connected to at least one of said dump door and said chute.

40. The dump hopper as defined in claim 30 wherein said moving means are connected between said dump door and said chute, and said moving means are pivotally connected to each of said dump door and said chute.

41. The dump hopper as defined in claim 30 wherein said moving means includes relatively reciprocally movable members.

42. The dump hopper as defined in claim 30 wherein said moving means include relatively reciprocally fluidically movable members.

43. The dump hopper as defined in claim 30 wherein said moving means include relatively reciprocally fluidically movable telescopic members.

44. The dump hopper as defined in claim 30 wherein said moving means include relatively reciprocally fluidically movable members, a fluid system in part defined by said fluidically movable members, said fluid system including means for fluidically controlling the speed of chute movement during the movement thereof from the first travel position to the second guiding position, means for sensing initial dump door movement upon arrival of the chute at the second guiding position, and means responsive to said sensing means for increasing fluid flow to said fluidically movable members to increase speed upon initial movement of said dump door from the first closed position to the second open position thereof.

45. The dump hopper as defined in claim 30 wherein said moving means include relatively reciprocally fluidically movable members, a fluid system in part defined by said fluidically movable members, said fluid system including means for fluidically controlling the speed of chute movement during the movement thereof from the first travel position to the second guiding position, means for sensing initial dump door movement upon arrival of the chute at the second guiding position, means responsive to said sensing means for increasing fluid flow to said fluidically movable members to increase speed upon initial movement of said dump door from the first closed position to the second open position thereof, and said sensing means is a proximity switch which senses the initial movement of the door.

46. The dump hopper as defined in claim 30 including first and second cooperative means for holding the dump door in the first closed position thereof during movement of the chute from the first travel position toward the second guiding position and releasing the dump door to the free movement thereof from the first closed position incident to the chute reaching substantially the second guiding position thereof, the dump door mounting means includes pivot means for effecting pivoting movement of said dump door between the first closed and second open positions thereof, the chute mounting means includes pivot means for effecting pivoting movement of said chute between the first travel and second guiding positions thereof, and said pivot means are located in vertically spaced relationship to each other.

47. The dump hopper as defined in claim 30 including first and second cooperative means for holding the dump door in the first closed position thereof during movement of the chute from the first travel position toward the second guiding position and releasing the dump door to the free movement thereof from the first closed position incident to the chute reaching substantially the second guiding position thereof, the dump door mounting means includes pivot means for effecting pivoting movement of said dump door between the first closed and second open positions thereof, the chute mounting means includes pivot means for effecting pivoting movement of said chute between the first travel and second guiding positions thereof, and said pivot means are located in vertically spaced relationship to each other with said dump door pivot means being above said chute pivot means.

48. The dump hopper as defined in claim 30 including first and second cooperative means for holding the dump door in the first closed position thereof during movement of the chute from the first travel position toward the second guiding position and releasing the dump door to the free movement thereof from the first closed position incident to the chute reaching substantially the second guiding position thereof, the dump door mounting means includes pivot means for effecting pivoting movement of said dump door between the first closed and second open positions thereof, the chute mounting means includes pivot means for effecting pivoting movement of said chute between the first travel and second guiding positions thereof, and said pivot means are located in vertically spaced relationship to each other with axes thereof being in substantially parallel relationship to each other.

49. A dump hopper comprising a container, an opening in the container, a dump door, means for mounting the dump door for movement between a first closed position closing the container opening and a second open position at which the container opening is open, a chute for guiding the discharge of contents outwardly of the container opening when the dump door is in the second open position thereof, means for mounting the chute for movement between a first travel position when the dump door is in the first closed position thereof and a second guiding position when the dump door is in the second open position thereof, means for moving said dump door and said chute between the respective first and second positions thereof, and means for holding the dump door in the first closed position until the chute is substantially in the second guiding position thereof.

50. The dump hopper as defined in claim 49 wherein said holding means include first and second cooperative cam and cam follower means.

51. The dump hopper as defined in claim 49 wherein said holding means include first and second cooperative cam and cam follower means carried one each by said dump door and said chute.

52. The dump hopper as defined in claim 51 including means for adjusting said holding means to selectively adjust the closing force of the dump door in the first closed position thereof.

53. The dump hopper as defined in claim 49 wherein said holding means include first and second cooperative cam and cam follower means carried respectively by said dump door and said chute.

54. The dump hopper as defined in claim 53 including means for sensing relative movement of the chute and dump door, and means responsive to said sensing means for increasing the opening speed of said moving means for moving said dump door to the second position thereof.

55. The dump hopper as defined in claim 49 including means for adjusting said holding means to selectively adjust the closing force of the dump door in the first closed position thereof.

56. The dump hopper as defined in claim 55 wherein said holding means include first and second cooperative cam and cam follower means.

57. The dump hopper as defined in claim 56 including means for sensing relative movement of the chute and dump door, and means responsive to said sensing means for increasing the opening speed of said moving means for moving said dump door to the second position thereof.

58. The dump hopper as defined in claim 55 wherein said holding means include first and second cooperative cam and cam follower means carried one each by said dump door and said chute.

59. The dump hopper as defined in claim 55 wherein said holding means include first and second cooperative cam and cam follower means carried respectively by said dump door and said chute.

60. The dump hopper as defined in claim 59 including means for sensing relative movement of the chute and dump door, and means responsive to said sensing means for increasing the opening speed of said moving means for moving said dump door to the second position thereof.

61. The dump hopper as defined in claim 55 including means for sensing relative movement of the chute and dump door, and means responsive to said sensing means for increasing the opening speed of said moving means for moving said dump door to the second position thereof.

62. The dump hopper as defined in claim 49 including means for sensing relative movement of the chute and dump door, and means responsive to said sensing means for increasing the opening speed of said moving means for moving said dump door to the second position thereof.

* * * * *